US008348141B1

(12) United States Patent
Weinstein

(10) Patent No.: US 8,348,141 B1
(45) Date of Patent: Jan. 8, 2013

(54) GEMSTONE PARCEL PAPER WITH A VIEWING WINDOW

(76) Inventor: Leonard Mark Weinstein, Las Vegas, NV (US)

( * ) Notice: Subject to any disclaimer, the term of this patent is extended or adjusted under 35 U.S.C. 154(b) by 300 days.

(21) Appl. No.: 12/878,720

(22) Filed: Sep. 9, 2010

Related U.S. Application Data

(63) Continuation-in-part of application No. 11/591,869, filed on Nov. 2, 2006, now abandoned.

(51) Int. Cl.
*B65D 65/16* (2006.01)
*B65D 27/04* (2006.01)
*B29D 22/00* (2006.01)

(52) U.S. Cl. ..... 229/87.06; 229/71; 428/34.3

(58) Field of Classification Search .... 229/87.01–87.19, 229/87.2, 87.5, 92.1, 92.3, 303, 304, 71, 229/75, 69; 428/14, 38, 34.2, 34.3, 535; 383/106; 150/154
See application file for complete search history.

(56) References Cited

U.S. PATENT DOCUMENTS

| | | | | | |
|---|---|---|---|---|---|
| 1,709,937 | A * | 4/1929 | Everard | ..... | 206/472 |
| 2,801,787 | A * | 8/1957 | Wicklund | ..... | 229/87.5 |
| 2,860,770 | A * | 11/1958 | Wagner et al. | ..... | 206/460 |
| 5,629,058 | A * | 5/1997 | Jones, III | ..... | 428/34.2 |
| 2007/0196609 | A1 * | 8/2007 | Collins | ..... | 428/40.1 |
| 2008/0107835 | A1 * | 5/2008 | Weinstein | ..... | 428/13 |

* cited by examiner

*Primary Examiner* — Jes F Pascua
(74) *Attorney, Agent, or Firm* — H. John Rizvi; Glenn E. Gold; Gold & Rizvi, P.A.

(57) ABSTRACT

A convenient, economical, novel parcel paper for folding to enclose a gemstone is provided, which includes three rectangular sheets of paper (or a paper-like material) and a thin, rectangular substantially transparent viewing pane attached to at least the inner one of the rectangular sheets. The three sheets include an outer cover sheet, a thin central flute, and a thin inner flute. Each of the sheets is configured with an open rectangular viewing window. The viewing pane is attached to the inner flute to form a continuous, unified sheet; thus when the cover, central flute, and inner flute are folded together with their viewing windows aligned, the viewing pane allows observation of the enclosed gemstone enclosed within the folded parcel paper.

19 Claims, 5 Drawing Sheets

GEMSTONE PARCEL PAPER WITH A VIEWING WINDOW

CROSS-REFERENCE TO RELATED APPLICATION

This Continuation-in-Part application claims the benefit of co-pending U.S. patent application Ser. No. 11/591,869, filed on Nov. 2, 2006, now abandoned, which is incorporated herein in its entirety.

FIELD OF THE INVENTION

The present invention relates generally to a device and method for storing and displaying a gemstone, and more particularly, to a foldable parcel paper with a viewing window for storing and displaying gemstones.

BACKGROUND INFORMATION

Precious gemstones, particularly diamonds, are generally protected, organized, and transported within folded parcel papers. Parcel papers are integral to diamond handling and protocols at every stage of the marketing process, yet have experienced only minimal advances in design and usefulness. The parcel paper is a set of at least two papers specially folded to form a folded envelope in which one or more diamonds (or other precious or semiprecious gemstones) can be transported and can be presented in a refined, elegant manner. A conventional parcel paper, which is sometimes referred to as a "diamond paper", is conventionally formed of three individual sheets of aligned paper, an outer opaque cover and two inner flutes (the thin, translucent inner liners). The unfolded three-sheet parcel paper is typically a standard seven inches by five and three fourths inches; the parcel paper is folded into a standard size, such as about three inches by two inches.

The color, texture, type, and weight of each the three sheets forming the parcel paper may be chosen on the basis of enhancing the features of a specific gemstone, reflecting light to add to the appeal of the gemstone, contrasting or harmonizing with the gemstone, or to achieve some other desirable effect. Thus the papers chosen may vary depending on the color and other aspects of the gemstone to be encased within the parcel paper. Often the selected smooth papers are polished to better reflect light. To present diamonds, often a preference is shown for an interior blue translucent flute, a central white or blue translucent flute, and a somewhat thicker white opaque outer cover.

The gemologist usually carries an industry-standard gem case (such as a gem portfolio, organizer, or wallet) for holding gemstone parcel paper, for example, a protective, high-quality, lidded, lined box configured to hold one row or multiple separate rows of many inserted folded parcel papers enclosing gemstones. To fill the gemstone case, the gemologist unfolds a folded, pre-creased parcel paper and positions a loose gemstone (or multiple gemstones) in the middle portion of the creased, aligned sheets. The parcel paper is then refolded along the pre-creased folds with the gemstone held securely within the middle portion. When the gemologist wishes to present the gemstone, the three-sheet folded parcel paper enclosing the gemstone of interest is unfolded so the gemstone can be presented upon the middle portion of the inner flute, with the inner flute resting upon the central flute that is resting upon the cover paper. The inner flute, central flute, and cover, though unfolded, retain the pre-creased folds, with the precious stone lying on top of the middle portion of the presented parcel paper. Thus the stone is not well secured.

While the standard parcel paper allows compact transportation and elegant presentation of gemstones, when a gemologist wishes to present a particular one of the gemstones enclosed within the row or rows of folded parcel papers stored within his gem case, the identical, closed folded parcel papers do not give an indication as to which stored gemstone is enclosed within which closed, folded parcel paper. Parcel papers must be fully opened for even rudimentary inspection, whereas the cursory glance is a standard action of diamond trade protocols.

Thus the gemologist must attempt to memorize the location of each of the many gemstones within the gem case, so he may correctly select the folded parcel paper encasing the desired gemstone, unfold the parcel paper, and present the opened parcel paper with the gemstone to the potential buyer, client, or other observer. However, this is quite difficult without an external indication of the enclosed gemstone. He may be required to withdraw and unfold one closed parcel paper after another—searching for the correct gemstone for presentation. Thus the desired elegant revealing of the precious stone may instead be an awkward, fumbling exhibition. Also, the repetitive physical movements required to unfold and refold such a large number of parcel papers is physically taxing and may lead to repetitive motion injuries or stress.

Additionally, the time spent opening a closed parcel paper is not trivial, yet the folded parcel paper must necessarily be fully opened to present the gemstone. Though the time required to unfold each parcel paper, to show the gemstone is not large, when scores of stones may be presented the cumulative time is multiplied and becomes significant. Time-in-motion studies indicate that the largest percentage of time expended in diamond business transactions (almost 85%) is spent on the multiple unfolding and refolding of individual parcel papers.

Thus a gemologist is required to spend more time than necessary both in locating the correct gemstone for presentation and in unfolding the closed parcel paper encasing the correct gemstone. No currently available folding parcel paper that fits in the standard gem case meets these needs, nor does any currently available standard packaging system.

Another problem faced by a gemologist when showing gemstones to an observer is the tendency of the opened parcel paper to fold back upon itself so that, the stone(s) is no longer viewable. Thus the gemologist must hold the parcel paper open or use a paper weight to hold it open. The present invention advantageously further provides a display stand that does not require the use of a paper weight.

Accordingly, there is an established need for a convenient, economical, parcel paper that allows a gemologist or other user to reduce the time necessary to open the folded parcel paper to show each gemstone and to reduce the time required to locate the correct gemstone enclosed within a folded parcel paper located among a plethora of other closed parcel papers within an industry-standard gem case.

SUMMARY OF THE INVENTION

The present invention is directed to an elegant, reusable, novel parcel paper with a viewing window that is folded to enclose a gemstone and that is usable in its folded state to display the gemstone encased within. It preferably includes three rectangular sheets of paper (or a paper-like material) and a thin, rectangular substantially transparent viewing pane attached to at least the inner one of the rectangular sheets. The three sheets include an outer cover sheet, a thin central flute, and a thin inner flute. Each of the sheets is configured with an open rectangular viewing window. The viewing pane is attached to the inner flute to form a continuous, unified sheet; thus when the cover, central flute, and inner flute are folded together with their viewing windows aligned, the viewing pane allows observation of the enclosed gemstone enclosed within the folded parcel paper.

An object of the present invention is to provide a gemstone parcel paper with a viewing window that reduces the time needed to locate a particular gemstone among many gemstones in parcel papers within a conventional industry-standard gem case.

A further object of the present invention is to provide a viewing-window parcel paper that is aesthetically pleasing.

Another object of the present invention is to provide a gemstone parcel paper with a viewing window that can be folded and stored in a conventional gem case.

An additional object of the present invention is to provide a gemstone parcel paper with a viewing window that allows selection, display, and presentation of the gemstone, while still enclosed within the novel parcel paper.

Another object of the present invention is to provide a gemstone parcel paper with a viewing window that may be used as a display frame for the enclosed gemstone.

A further object of the present invention is to provide a gemstone parcel paper with a viewing window that reduces the need for repetitive physical movement, reducing the chance of repetitive motion injury.

These and other objects, features, and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Shown throughout the figures, the present invention is directed toward a simple, inexpensive, practical, convenient, and novel gemstone parcel paper with a viewing window. The gemstone parcel paper is useful for compactly storing and elegantly displaying one or more unmounted gemstones (particularly diamonds, but also other precious and semi-precious stones). The gemstone parcel paper is configured with a viewing window providing simplified access and convenience in selecting the proper gemstone when many gemstones encased in parcel papers are stored in a conventional gem case of the prior art. Additionally, the viewing window of the gemstone parcel paper of the current invention allows the parcel paper to be used as a vertical or horizontal display stand, presenting an easy means for a gemologist to create an appealing, secure display of multiple gemstones on a horizontal surface, without manually holding the folded papers of the parcel paper open and without using a paperweight.

Figure 15:
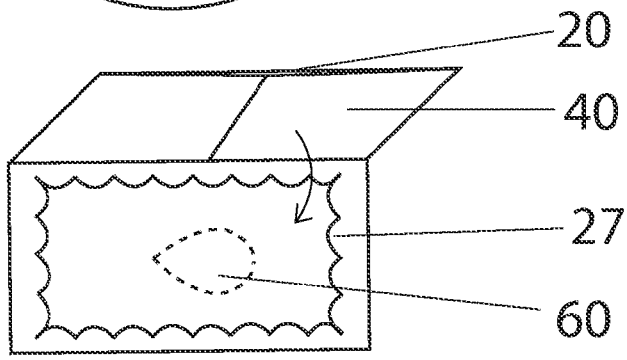
FIG. 15 is a perspective view showing a third embodiment of the partially-folded gemstone parcel paper with a viewing window of the present invention.
Figure 16:
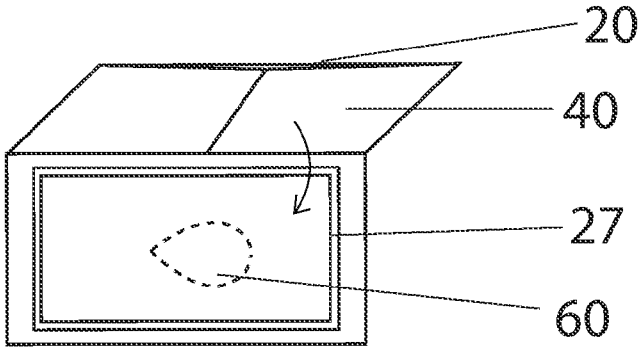
FIG. 16 is a perspective view showing a fourth embodiment of the partially-folded gemstone parcel paper with a viewing window of the present invention.

Four embodiments are presented, a first embodiment, (FIG. 8), a second preferred embodiment (FIG. 13), a third embodiment (FIG. 15), and a fourth embodiment (FIG. 16). An exemplary method of folding the parcel paper is illustrated in FIG. 3 to FIG. 7 is illustrated.

Figure 1:
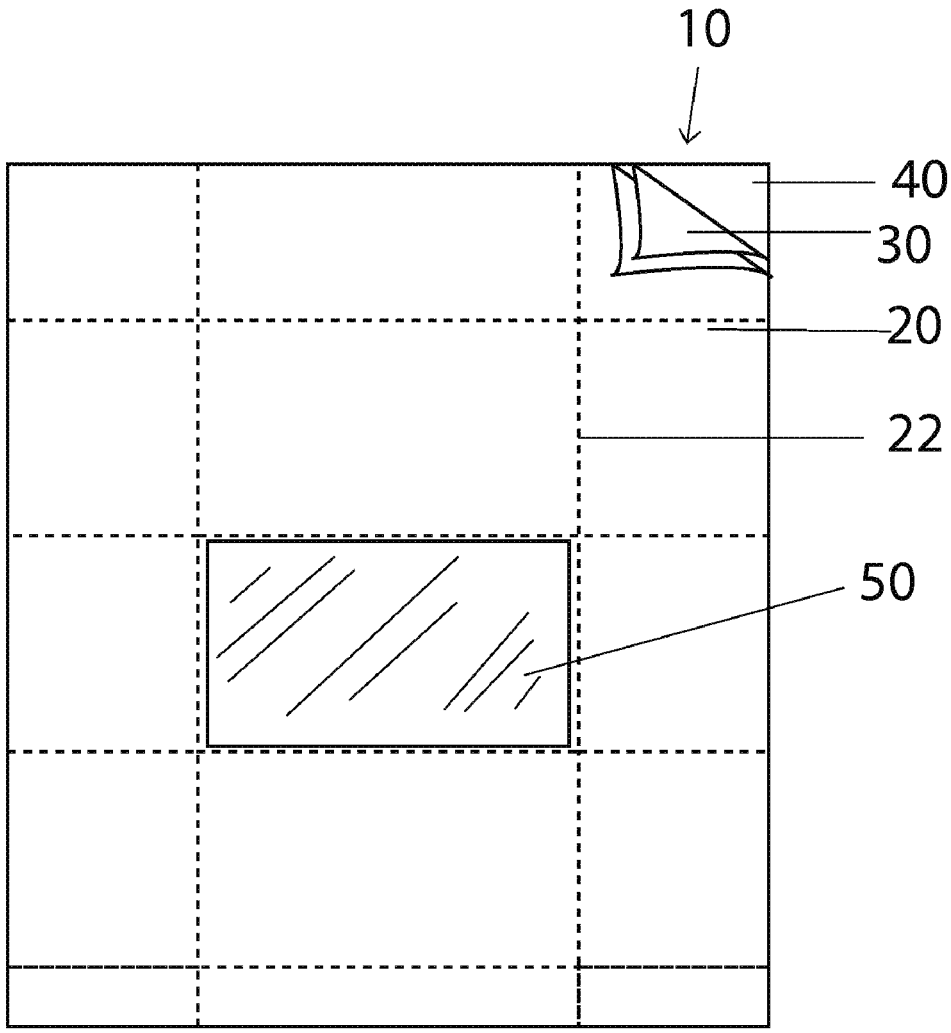
FIG. 1 is a top view showing a preferred embodiment of the unfolded gemstone parcel paper with a viewing window of the present invention.
Figure 11:
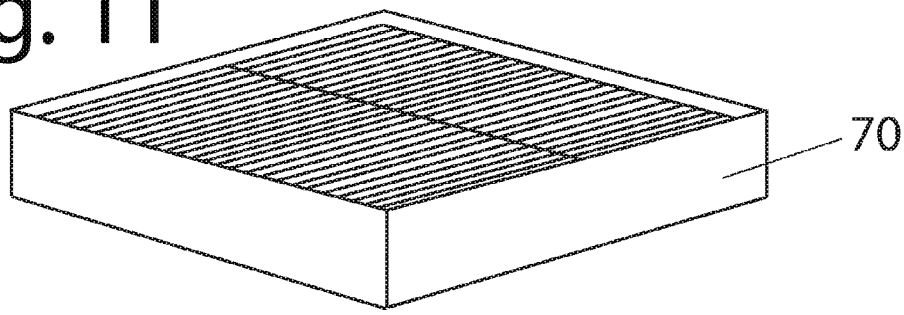
FIG. 11 is a standard parcel paper gem case or transport box of the prior art, such as could be used to store multiple conventional folded parcel papers of the prior art or could be used to store multiple viewing-window parcel papers of the present invention.

Referring now to FIG. 1, a gemstone parcel paper with a viewing window, shown generally as reference number 10, is illustrated in accordance with the various embodiments of the present invention. As shown, the gemstone parcel paper with a viewing window 10 comprises a cover 40, a central flute 30, an inner flute 20, and a viewing pane 50. The parcel paper is preferably produced in a standard size, so that, when folded, it fits within the conventional parcel paper industry-standard gem case 70 (FIG. 11). The standard unfolded size is approximately 185-190 mm by 165-170 mm, with the parcel paper typically folded to around 45-50 mm by 80-95 mm.

The cover 40, central flute 30, and inner flute are each formed of a thin, flexible sheet. The thin, flexible sheet may be a'paper formed of any of a variety of fibers (such as cellulose, linen, cotton, etc.) as is known, or may become known, in the art. Optionally the thin, flexible sheet may be formed of papers formed by special manufacturing techniques (such as glassine) or formed by application of special coatings (wax paper, oiled parchment, etc.). Or the thin, flexible sheet may be formed of a paper-like material, such as synthetic materials or partially synthetic media, (TYVEK®, TESLIN®, etc.). The cover 40 is preferably formed of a more durable paper, such as cotton rag paper, while the central flute 30 and inner flute 20 are preferably formed of an aesthetically pleasing paper having at least a degree of translucency, such as glassine or parchment.

Figure 12:
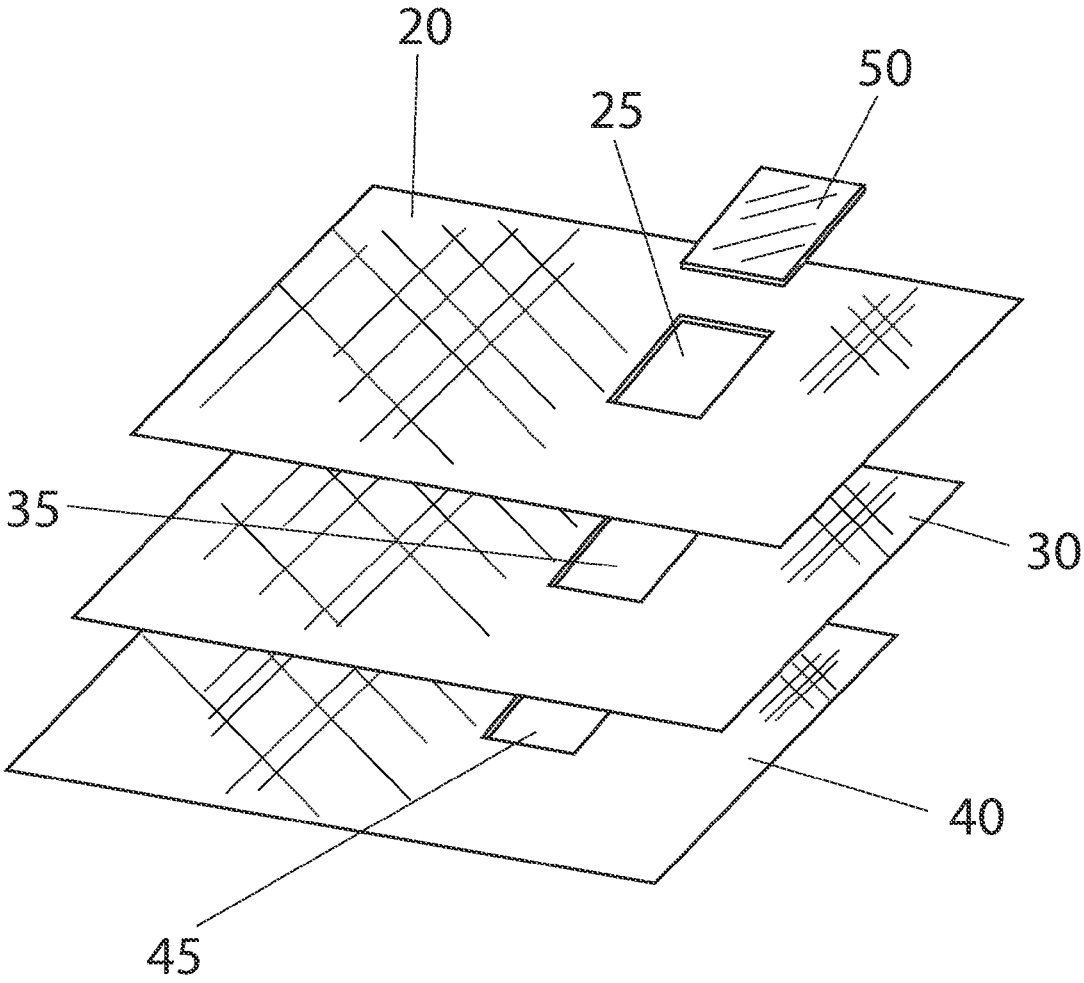
FIG. 12 is an expanded perspective view showing a preferred embodiment of the partially-folded gemstone parcel paper with a viewing window of the present invention.

The rectangular outer cover sheet 40 is formed of a flexible sheet that is sturdy enough to provide a degree of protection to the thinner inner liners (flutes 20, 30). Cover 40 is configured with a rectangular aperture, cover viewing window 45 (FIG. 12). The open cover viewing window 45 is preferably formed by removal of an interior portion of the flexible sheet material. The cover viewing window 45 is offset from the center to correspond to the location of the rectangle formed in the conventional folding of parcel papers, as illustrated.

The conventional folding usually produces a rectangle of around 45 to 50 mm tall and 80 to 95 mm wide. The cover viewing window 45 is preferably slightly smaller than this folded size (45 to 50 mm tall and 80 to 95 mm wide) to allow a paper edging 29 (FIG. 8) to show around the viewing pane 50, when the parcel paper is folded into the standard rectangular shape.

The central flute 30 and inner flute 20 are also formed of a thin, flexible sheet that is preferably thinner and more translucent than the cover 40. The flutes 20, 30 are preferably slightly smaller than the cover 40. This prevents an edge of a flute 20, 30 from extending beyond the cover 40, so provides an additional level of protection. The slightly smaller flutes 20, 30 also make folding easier, as extreme precision is not required, yet the folded parcel paper 10 looks neat, with no flute edges exposed.

Both central flute 30 and inner flute 20 are configured with a rectangular aperture, central viewing window 35 (FIG. 12) and inner viewing window 25 (FIG. 12), respectively. Both flute viewing windows 25, 35 are preferably formed by removal of a an interior portion of the thin, flexible sheet material. The size and location of central viewing window 35 and inner viewing window 25 substantially correspond to the size and location of the cover viewing window 45 when the three sheets are aligned for folding.

Figure 2:
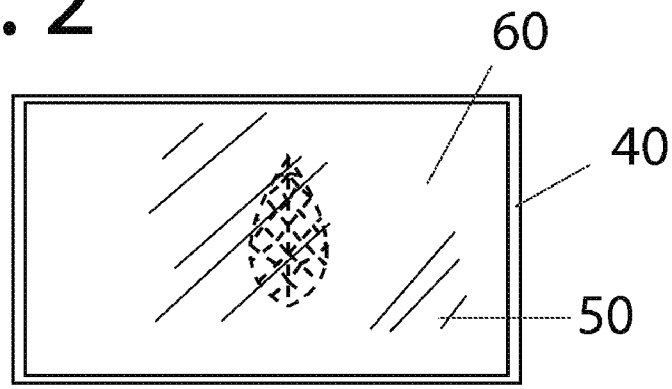
FIG. 2 is a top view showing the viewing-window middle portion of a preferred embodiment of the folded gemstone parcel paper with a viewing window of the present invention.
Figure 10:
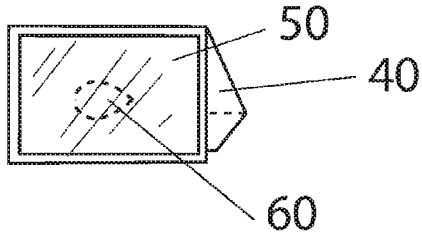
FIG. 10 is a perspective view showing a preferred embodiment of the partially-unfolded gemstone parcel paper with a viewing window of the present invention used as a horizontal display stand.

FIG. 2 shows a gemstone 60 encased within the folded parcel paper 10 of the present invention and viewable through viewing pane 50 when the top flap of the folded parcel paper 10 is folded backward, as in the horizontal display stand position of FIG. 10.

Figure 3:
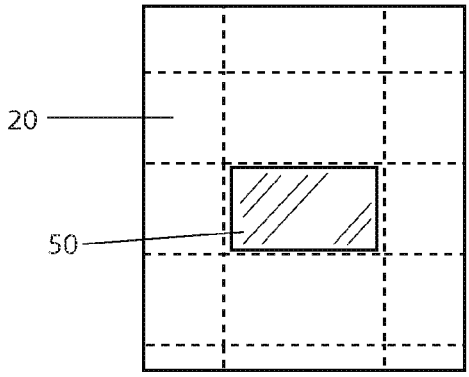
FIG. 3 to FIG. 7 are top views showing the steps of folding of a preferred embodiment of the gemstone parcel paper with a viewing window of the present invention.

FIG. 3 to FIG. 7 show the steps of folding the viewing-window parcel paper 10 of the present invention. FIG. 3 shows the interior of the unfolded, but pre-creased parcel paper 10. The three sheets 20, 30 (FIG. 4), 40 (FIG. 4) of the parcel paper 10 are aligned with the inner flute 20 facing upward in the illustration.

Figure 4:
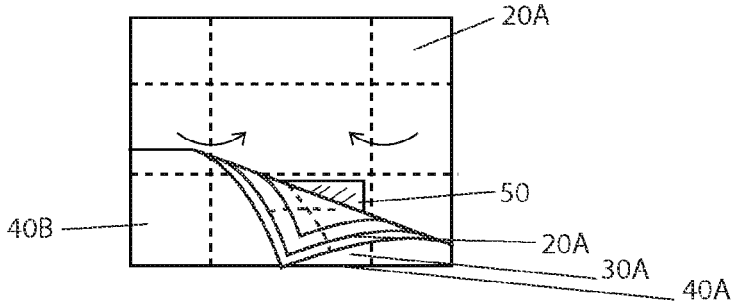

FIG. 4 shows the upward folding of the generally aligned bottom edges of cover 40, central flute 30, and inner flute 20. Both the inner surface 40A of cover 40 and the outer surface 40B of cover 40 are shown. Also, both the inner surface 20A and outer surface 20B of inner flute 20 are shown. But only the central flute inward-facing surface 30A is visible in the turned down corner. The arrows show the direction of the next fold.

Figure 5:
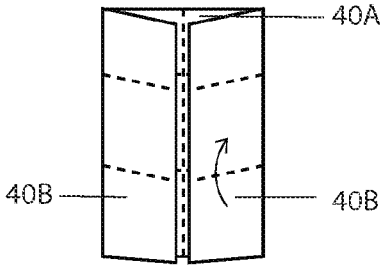

FIG. 5 shows the inward folding of the right and left side edges of cover 40, central flute 30, and inner flute 20. The bottom rectangular section (the viewing-window middle portion) is then folded upward, as indicated by the arrow, to arrive at the configuration shown in FIG. 6.

Figure 6:
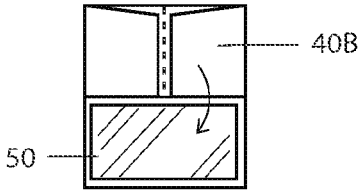

FIG. 6 shows the upward folding of the viewing-window middle portion of FIG. 5, causing the viewing pane 50 to become visible.

Figure 7:
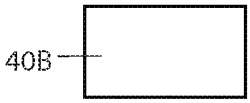

FIG. 7 shows the top flap folded downward over the viewing pane 50 to enclose the gemstone 60 for protection. The folded parcel paper 10 with the enclosed gemstone may then be inserted into the standard gem case 70 of FIG. 11.

Optionally, from the folded position of FIG. 6, the parcel paper can be partially opened. The partially-unfolded parcel paper forms a triangular-configuration suitable for use as a display stand. It may then be positioned to exhibit the enclosed gemstone 60, either as a horizontal display stand, as in FIG. 10, or as a vertical display stand, as in FIG. 9.

Figure 8:
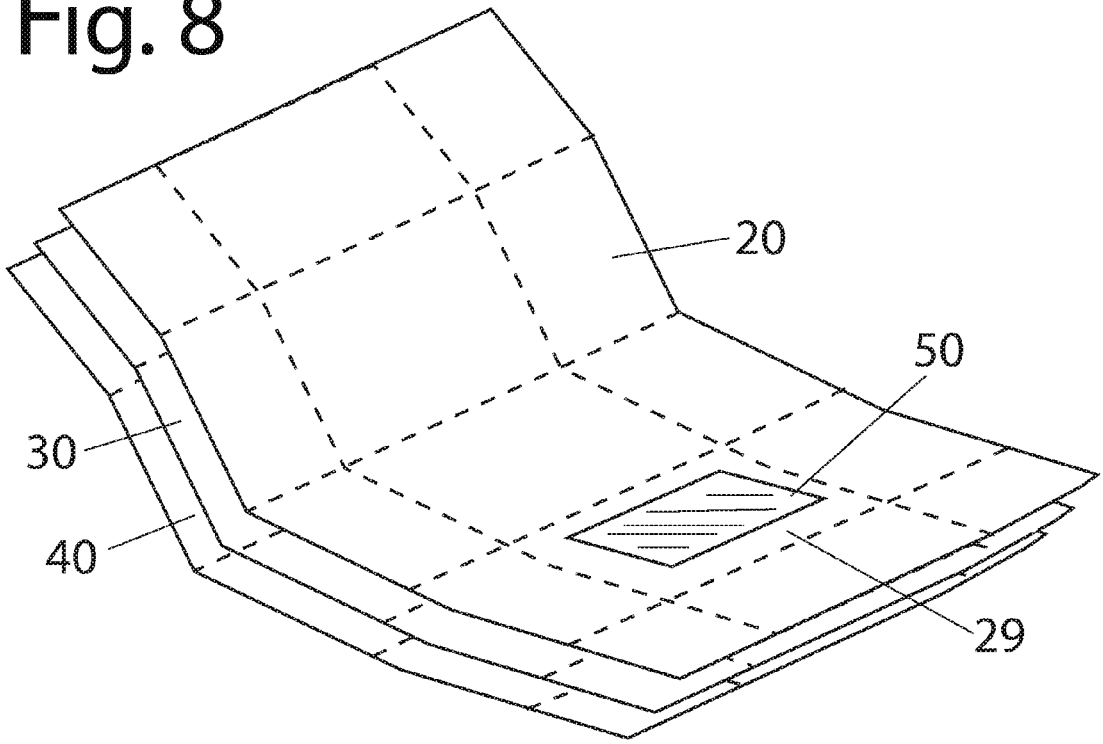
FIG. 8 is a perspective view showing a first embodiment of the pre-creased gemstone parcel paper with a viewing window of the present invention.

FIG. 8 shows the first embodiment of the viewing-window parcel paper 10 of the present invention. In the first embodiment, the viewing pane 50 is attached only to the inner flute 20. When the cover 40, central flute 30, and inner flute 20 are aligned for folding, the continuous sheet formed by inner flute 20 and viewing pane 50 restrain the enclosed gemstone. Similarly, second and third viewing panes (not shown) can be attached to central flute 30 and cover 40, respectively. Thus three separate continuous sheets are formed, each with a viewing pane 50 filling in the viewing windows 25, 35, 45. Optionally, only the inner flute 20 may have an attached viewing pane 50, with the open viewing windows 35, 45 aligned with viewing pane 50 within viewing pane 25, while still permitting observation of the gemstone enclosed within the continuous inner flute 20 and pane 50.

Figure 9:
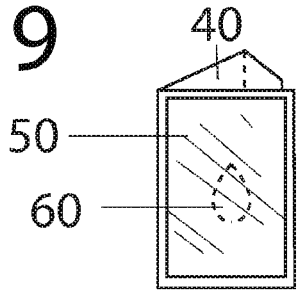
FIG. 9 is a perspective view showing a preferred embodiment of the partially-unfolded gemstone parcel paper with a viewing window of the present invention used as a vertical display stand.

FIG. 9 and FIG. 10 illustrate the vertical and horizontal display exhibits formed by partially unfolding the viewing-window parcel paper 10. The partially-unfolded parcel paper 10 is formed by unfolding the top flap to reveal the viewing-window middle portion, and then positioning the top flap to abut the viewing-window middle portion. This forms a triangular configuration useable as a stand for safely displaying the enclosed gemstone when positioned upon a table or other horizontal surface. Thus the viewing-window parcel paper 10 easily converts to serve as a portable display, ideal for diamond and gemstone dealers anywhere in the world to present their inventories to the best possible advantage. The gemologist can quickly display multiple gemstones in an aesthetically pleasing manner. Each display exhibit is self-contained and self-standing, thus freeing the hands of the gemologist and eliminating the need for paperweights.

FIG. 12 shows an exploded view of the parcel paper 10, illustrating a single viewing pane 50 to be adhered to cover the viewing window 25 of inner flute 20 in either the first or second embodiment. The viewing pane 50 is preferably slightly larger than the viewing window 25 to accommodate attachment. The peripheral edges of the viewing pane 50 extend somewhat past the border of viewing window 25, to allow sufficient overlap for joining the peripheral edges of the viewing pane 50 to the border of the viewing window 25. Any type of attaching method, as is known or may become known in the art, is within the scope of the invention. For example, the attachment means may be by chemical means (such by use of any of the variety of available adhesives) or by mechanical means (such as by use of mechanical pressing, binding with threads, or ultrasonic welding fusing ingredients of the paper).

Figure 13:
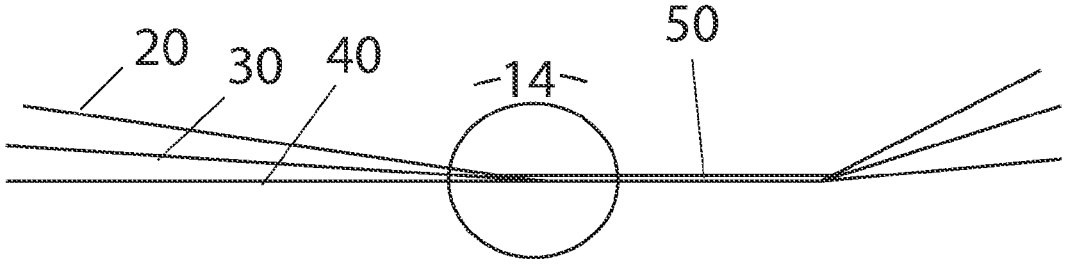
FIG. 13 is a side view showing a second preferred embodiment of the partially-folded gemstone parcel paper with a viewing window of the present invention.
Figure 14:
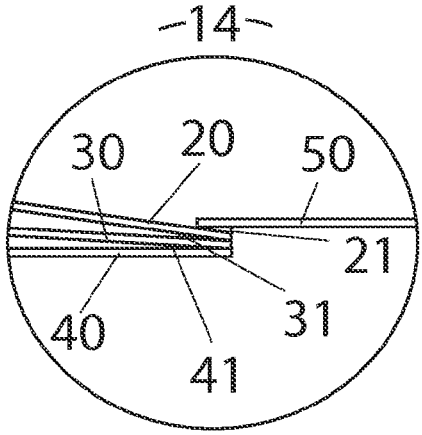
FIG. 14 is a detail view of Circle 14 of FIG. 13 showing a second preferred embodiment of the partially-folded gemstone parcel paper with a viewing window of the present invention.

In the second preferred embodiment of FIG. 13 and FIG. 14, the viewing pane 50 is attached over the viewing window 25 with all three sheets (cover 40, central flute 30, and inner flute 20) attached (mechanically or chemically) to each other at the edge of viewing window 25.

As seen in the close-up view of FIG. 14, in the preferred second embodiment, the borders of viewing windows 25, 35, 45 of inner flute 20, central flute 30, and cover 40, respectively, are all attached to each other (by either chemical or mechanical means). An attachment element 21, 31, 41 (disposed between each edge of the viewing windows of sheets 20, 30, 40) may bind or adhere the borders of viewing windows 25, 35, 45. The attachment element 21, 31, may be adhesive, thread or filaments, an ultrasonic welding, or the like.

Optionally, though the three sheet parcel paper is an industry standard, the viewing-window parcel paper 10 can be formed without a central flute 30 (having only inner flute 20 and outer cover 40) or may be formed with two or more central flutes. Also, optionally, though the viewing windows and viewing pane have been described as rectangular, many other shapes and designs could equally well be used and are within the scope of the invention.

FIG. 15 and FIG. 16 illustrate optional third and fourth embodiments, demonstrating that the edges of viewing window 25 are not necessarily smooth and sharp as in the first two embodiments, but may instead be embellished edges 27. Optionally, the edges of central viewing window 35 and inner viewing window 25 may be smooth, with the cover viewing window embellished; thus preventing an irregular alignment of embellishments.

The embellished edge 27 of FIG. 15 is scalloped to add interest to the gemstone encased within the parcel paper 10, particularly when the parcel paper 10 is used as a display stand. The embellished edge 27 of FIG. 16 comprises an embossed decorative ridge. Other embellished edge designs are within the scope of the invention, such as a foil edging adhered around the viewing window, colors, textures, cutouts, and the like.

To make the parcel paper 10 of the present invention, a sturdy paper for the outer cover 40 is chosen to provide a degree of strength and protection to the inner flutes and the gemstone(s) to be enclosed. A second type of paper is chosen for the central flute 30 and inner flute 20; this second type of paper is more transparent than the cover and is preferably polished to reflect light Optionally, the central flute 30 can be of a third type of paper.

Each of the sheets 20, 30, 40 chosen is configured with an interior viewing window 25, 35, 45, such as by cutting and removing the material. The viewing window may be configured to have plain edges 29 (FIG. 10) or may be configured to have embellished edges 27 (FIG. 15, FIG. 16).

In the first embodiment, the viewing pane 50 is attached to the edges of viewing window 25, then the three sheets 20, 30, 40 are pre-creased with the viewing windows 25, 35, 45 aligned. (Optionally, a second viewing pane 50 may be attached to the edges of central viewing window 35 and a third viewing pane 50 may be attached to the edges of cover 40.)

In the second preferred embodiment, the viewing pane 50 is attached to the edges of viewing window 25 with all three sheets (cover 40, central flute 30, and inner flute 20) attached to each other at the edge of viewing window 25.

The viewing-window parcel paper 10 is then pre-creased per industry standards and sold for use to store, transport, and display gemstones.

To use the viewing window parcel paper 10, the three-sheet pre-creased parcel paper is unfolded and one or more loose gemstones are placed in the middle portion on the viewing window with the bottom portion then folded upward, with both left and right side portions folded inward, then with the viewing-window middle portion folded upward, and then with the top flap folded downward over the viewing-window middle portion.

The folded parcel paper 10 with the enclosed gemstone may then be placed in a conventional gem case 70 (FIG. 11). When the gemologist wishes to present the stones, a first parcel paper is withdrawn from the gem case 70, and, with only a quick unfolding of the top flap, the gemologist can quickly determine that the gemstone enclosed within the first parcel paper is (or is not) the desired gemstone to present, reducing the time required to view the enclosed gemstone substantially (to about 15% of the time required to unfolded and view the gemstone enclosed in conventional non-viewing-window parcel paper).

When the last fold of the viewing-window parcel paper 10 is unfolded, the viewing-window parcel paper 10 may also be placed on a flat surface as a vertical display stand (FIG. 9) or as a horizontal display stand (FIG. 10). Multiple gemstones can easily be displayed without use of paperweights. Also, the unmounted stones are protected from mishaps that may occur during merchandise inspection, reducing embarrassment to the handler and possible damage to the stones. Yet the standard, three-layer construction conforms to prevalent industry standards for "back-flap", as required by lot sales professionals in diamonds and precious gems.

From the foregoing, it will be apparent that the viewing-window parcel paper 10 of the current invention provides an improved parcel paper that provides an aesthetically pleasing observation of the enclosed gemstone, that can be folded and stored in a conventional gem case, that reduces time required to find a particular gemstone among numerous gemstones within parcel papers within a industry-standard gem case, that improves safety and gem handling, and that allows presentation and display of, the gemstone, while the gemstone is still enclosed within the novel parcel paper.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. A parcel paper, comprising:

a rectangular outer cover sheet configured with an open cover viewing window;

a rectangular, thin central flute sheet configured with an open central viewing window substantially corresponding in size and positioning to said cover viewing window;

a rectangular, thin inner flute sheet size configured with an open inner viewing window substantially corresponding in size and positioning to said cover viewing window; said cover viewing window, said central viewing window, and said inner viewing window are generally rectangular;

the edges of said cover viewing window, said central viewing window, and said inner viewing window are attached to each other; and a thin, rectangular substantially transparent viewing pane sized somewhat larger than said inner viewing window and attached to said inner flute to close said inner viewing window to form a continuous, unified sheet, wherein upon aligning and folding said cover, said central flute, and said inner flute together a gemstone may be secured within; and wherein partially unfolding the aligned and folded said cover, said central flute, and said inner flute allows observation of the said gemstone secured within.

2. The parcel paper as recited in claim 1, wherein the edges of said cover viewing window, said central viewing window, and said inner viewing window are attached by a first adhesive.

3. The parcel paper as recited in claim 2, wherein; and said viewing pane is attached to said inner flute by a second adhesive.

4. The parcel paper as recited in claim 3, wherein said outer cover sheet, said central flute, and said inner flute are between 185 mm and 190 mm in height and between 165 mm and 170 mm in width.

5. The parcel paper as recited in claim 2, wherein said viewing pane is attached to said inner flute by a mechanical means.

6. The parcel paper as recited in claim 5, wherein said mechanical means comprises ultrasonic welding.

7. The parcel paper as recited in claim 1, wherein the edges of said cover viewing window, said central viewing window, and said inner viewing window are attached by a first mechanical means.

8. The parcel paper as recited in claim 7, wherein said viewing pane is attached to said inner flute by an adhesive.

9. The parcel paper as recited in claim 7, wherein said viewing pane is attached to said inner flute by second mechanical means.

10. The parcel paper as recited in claim 9, wherein said first mechanical means and said second mechanical means comprise ultrasonic welding.

11. The parcel paper as recited in claim 10, wherein said outer cover sheet, said central flute, and said inner flute are between 185 mm and 190 mm in height and between 165 mm and 170 mm in width.

12. The parcel paper as recited in claim 1, wherein:

said rectangular cover viewing window is configured with straight edges;

said central viewing window is configured with straight edges; and said inner viewing window is configured with straight edges.

13. The parcel paper as recited in claim 1, wherein said rectangular cover viewing window is configured with embellished edges.

14. A display stand for displaying a gemstone, comprising a folded envelope, said folded envelope comprising:

a rectangular outer cover sheet configured with a rectangular open cover viewing window;

a rectangular, thin central flute sheet configured with a rectangular open central viewing window substantially corresponding in size and positioning to said cover viewing window;

a rectangular, thin inner flute sheet size configured with a rectangular open inner viewing window substantially corresponding in size and positioning to said cover viewing window, wherein the edges of said cover viewing window, said central viewing window, and said inner viewing window are attached; and a thin, rectangular substantially transparent viewing pane sized somewhat larger than said inner viewing window and attached to said inner flute to close said inner viewing window to form a continuous, unified sheet, wherein said cover, said central flute, and said inner flute are folded together to form said folded envelope; wherein said viewing pane allows observation of an interior portion of said folded envelope, whereby said gemstone folded within said folded envelope is observable; and wherein a partial unfolding of said envelope produces a triangular-configuration suitable for placing on a flat surface in a manner allowing viewing of said gemstone folded within said folded envelope.

15. The display stand for displaying a gemstone, as recited in claim 14, wherein the edges of said cover viewing window, said central viewing window, said inner viewing window, and said viewing pane are adhesively joined.

16. The display stand for displaying a gemstone, as recited in claim 14, wherein the edges of said cover viewing window, said central viewing window, said inner viewing window, and said viewing pane are mechanically joined.

17. A method of folding a parcel paper comprising:

obtaining a parcel paper comprising an outer cover with a cover viewing window, a central flute with a central viewing window, an inner flute with an inner viewing window, and a viewing pane closing said cover viewing window, said central viewing window, and said inner viewing window;

aligning said outer cover, said central flute, and said inner flute;

folding upward a lower portion of the aligned said outer cover, said central flute, and said inner flute;

folding inward a left portion of the aligned said outer cover, said central flute, and said inner flute with said lower portion previously folded upward;

folding inward a right portion of the aligned said outer cover, said central flute, and said inner flute with said lower portion previously folded upward;

folding upward the combined inwardly folded left portion, inwardly folded right portion, and the lower center portion of the aligned said outer cover, said central flute, and said inner flute to form a viewing-window middle portion; and folding downward the combined inwardly folded left portion, inwardly folded right portion, and the upper center portion of the aligned said outer cover, said central flute, and said inner flute to form a top flap, wherein said top flap can be manually positioned over said viewing-window middle portion to shield said viewing-window middle portion from view, and wherein said top flap can be manually positioned abutting said viewing-window middle portion to form a display stand.

18. The method of folding a parcel paper, as recited in claim 17, wherein the edge of said cover viewing window, the edge of said central viewing window, the edge of said inner viewing window, and the outer edge of said viewing pane are adhesively joined.

19. The method of folding a parcel paper, as recited in claim 17, wherein the edge of said cover viewing window, the edge of said central viewing window, the edge of said inner viewing window, and the outer edge of said viewing pane are mechanically joined.

* * * * *